US008188027B2

(12) United States Patent
Lynch et al.

(10) Patent No.: US 8,188,027 B2
(45) Date of Patent: May 29, 2012

(54) LIQUID FABRIC ENHANCER COMPOSITION COMPRISING A DI-HYDROCARBYL COMPLEX

(75) Inventors: Matthew Lawrence Lynch, Mariemont, OH (US); Yonas Gizaw, Cincinnati, OH (US); Thomas Edward Kodger, Cambridge, MA (US); Lois Jean Boekley, Cincinnati, OH (US); Mark Robert Sivik, Mason, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 177 days.

(21) Appl. No.: 12/505,582

(22) Filed: Jul. 20, 2009

(65) Prior Publication Data

US 2011/0015113 A1 Jan. 20, 2011

(51) Int. Cl.
*C11D 17/00* (2006.01)

(52) U.S. Cl. ..... 510/296; 510/297

(58) Field of Classification Search ..... 510/296, 510/297

See application file for complete search history.

(56) References Cited

U.S. PATENT DOCUMENTS

| | | | | | |
|---|---|---|---|---|---|
| 3,933,672 | A | * | 1/1976 | Bartolotta et al. | 510/438 |
| 4,259,215 | A | | 3/1981 | Murata et al. | |
| 4,321,165 | A | * | 3/1982 | Smith et al. | 510/350 |
| 4,569,800 | A | | 2/1986 | Stanley et al. | |
| 4,888,119 | A | | 12/1989 | Klewsaat | |
| 5,204,010 | A | | 4/1993 | Klewsaat | |
| 5,466,394 | A | | 11/1995 | de Buzzaccarini et al. | |
| 5,490,944 | A | | 2/1996 | Suazon | |
| 5,747,443 | A | | 5/1998 | Wahl et al. | |
| 5,919,751 | A | | 7/1999 | Bird et al. | |
| 6,008,178 | A | * | 12/1999 | Baillely et al. | 510/392 |
| 6,110,886 | A | | 8/2000 | Scepanski | |
| 6,136,769 | A | | 10/2000 | Asano et al. | |
| 6,211,140 | B1 | | 4/2001 | Sivik et al. | |
| 6,291,421 | B1 | | 9/2001 | Jacques et al. | |
| 6,306,805 | B1 | | 10/2001 | Bratescu et al. | |
| 6,521,589 | B2 | | 2/2003 | Demeyere et al. | |
| 2002/0198129 | A1 | | 12/2002 | Ushio et al. | |
| 2003/0008799 | A1 | | 1/2003 | Barnabas et al. | |
| 2003/0060390 | A1 | | 3/2003 | Demeyere et al. | |
| 2005/0020476 | A1 | | 1/2005 | Wahl et al. | |
| 2005/0164905 | A1 | | 7/2005 | Chawla et al. | |
| 2007/0105739 | A1 | | 5/2007 | Wahl et al. | |
| 2009/0042765 | A1 | | 2/2009 | Gizaw et al. | |

FOREIGN PATENT DOCUMENTS

| | | |
|---|---|---|
| GB | 2 323 376 A | 9/1998 |
| WO | WO 98/20092 A2 | 5/1998 |
| WO | WO 2006/072083 | 7/2006 |

OTHER PUBLICATIONS

International Search Report; International Application No. PCT/US2010/042032; mailed Nov. 17, 2010; 4 pages.

* cited by examiner

*Primary Examiner* — John Hardee

(74) *Attorney, Agent, or Firm* — James F. McBride; Melissa G. Krasovec; Steven W. Miller

(57) ABSTRACT

A fabric enhancer composition comprising a di-hydrocarbyl complex formed from a mono-hydrocarbyl quaternary ammonium component comprising the structure:

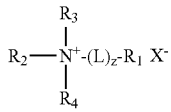

wherein R1 comprises a C6-C18 hydrocarbyl chain, wherein R2, R3 and R4 are individually selected from the group consisting of C1-C4 hydrocarbyl, C1-C4 hydroxy hydrocarbyl, —($CH_2CH_2O$)xH where x has a value from about 1 to about 2, and mixtures thereof, L is a linking group selected from the group consisting of C(O)O—, —$(CH_2CH_2O)_n$—, —C(O)—, [$CH_2CH(CH_2)O$] and n has value of 1 to 2 with z having a value of 0 or 1, and an anionic surfactant, wherein the fabric enhancer composition provides sufficient softness and anti-static benefits.

4 Claims, No Drawings

LIQUID FABRIC ENHANCER COMPOSITION COMPRISING A DI-HYDROCARBYL COMPLEX

BACKGROUND OF THE INVENTION

The use of cationic quaternary ammonium compounds ("quats") for delivering fabric enhancing benefits in the laundry process is known. Examples of two classes of cationic quats for use in fabric softeners include: di-alkyl quats having two carbon chains of length 12 to 18 carbons in length, and mono-alkyl quats. See U.S. Pat. Nos. 6,291,421, 6,110,886, 5,919,751, 5,490,944, 4,888,119, 4,569,800; and US Publ. Nos. 2007/0105739, 2005/0020476.

It is believed that many fabric enhancer compositions comprising cationic quats having two alkyl or alkenyl chains tend to suffer from phase stability problems as demonstrated by the cationic quats aggregating over time ultimately resulting in the formation of flocs or other precipitates and even visible phase separation. This problem of phase stability is believed to be exacerbated when additional fabric enhancer actives, such as cationic polymers, are introduced into the composition. Compositional incompatibility is particularly problematic when the end product is made and packaged at a centralized manufacturing site, followed by being shipped great distances across varying temperatures and air pressures. Additionally, it is desired to minimize any compositional incompatibility problems in the end product over extended periods of time as the period between manufacturing and ultimate end use may be several months.

Manufacturers have introduced mono-alkyl quats as one way to avoid phase stability problems. Mono-alkyl quats, however, are rather expensive and may be inferior to di-alkyl quats, with respect to softening and antistatic benefits under certain laundering conditions. See U.S. Pat. No. 5,466,394, US Patent Publ. No. 2005/0164905, and WO 2006/072083. Other attempts to address compositional incompatibility include the addition of select solvent systems to control the behavior of the cationic quats. See e.g. U.S. Pat. Nos. 6,521,589, 6,211,140, 5,747,443, and US Publ. No. 2003/0060390. Many of these select solvent systems, however, are so expensive as to be cost prohibitive for commercial use. Additional attempts to improve phase stability include the use of processing technologies to create uni-lamellar vesicles of a specific size. See, e.g., US Publ. No. 2009/0042765A1. Additionally, attempts to formulate wash compositions comprising anionic and cationic surfactant complexes have been made for wash formulations. See, e.g. U.S. Pat. No. 5,204,010. These formulations however are designed as wash formulations typically comprising more anionic surfactant than cationic surfactant.

Despite these and other attempts to control compositional incompatibility, there remains an ongoing search for fabric enhancer compositions which are less susceptible to phase stability problems and are commercially viable from a cost perspective.

SUMMARY OF THE INVENTION

One aspect of the present invention provides for a fabric enhancer composition comprising: a mono-hydrocarbyl quaternary ammonium compound having the formula:

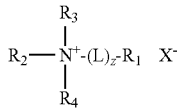

wherein $R_1$ comprises a $C_6$-$C_{18}$ hydrocarbyl chain, wherein $R_2$, $R_3$ and $R_4$ are individually selected from the group consisting of $C_1$-$C_4$ hydrocarbyl, $C_1$-$C_4$ hydroxy hydrocarbyl, $—(CH_2CH_2O)_xH$ where x has a value from about 1 to about 2, and mixtures thereof, L is a linking group selected from the group consisting of —C(O)O—, $—(CH_2CH_2O)_n—$, —C(O)—, $[CH_2CH_2(CH_2)O]$ and n has value of 1 to 2 with z having a value of 0 or 1, and wherein $X^-$ is a counter anion or an anionic surfactant comprising a $C_6$-$C_{16}$ hydrocarbyl chain, wherein at least a portion of said mono-hydrocarbyl quaternary ammonium compound and said anionic surfactant form a di-hydrocarbyl complex where the counter anion is replaced by said anionic surfactant.

Another aspect provides for a kit comprising a first package containing a mono-hydrocarbyl quaternary ammonium as defined herein, and a second package containing an anionic surfactant as defined herein.

Yet another aspect comprises: a water-soluble film optionally comprising a polyvinyl alcohol; from about 0.05 grams to about 100 grams of a fabric enhancer composition comprising: an mono-hydrocarbyl quaternary ammonium compound as defined herein, wherein said fabric enhancer composition is within said water-soluble film.

Another aspect provides a method of softening a fabric through the wash and/or rinse process comprising: dispensing into a wash and/or bath solution from about 0.05 grams to about 100 grams of a fabric enhancer composition to form a treated wash and/or rinse bath solution, said fabric enhancer composition comprising: an mono-hydrocarbyl quaternary ammonium compound as defined herein and optionally, from about 1% to about 90% of an anionic surfactant composition; and contacting a fabric with the treated wash and/or rinse bath solution.

DETAILED DESCRIPTION OF THE INVENTION

Definitions

As defined herein, "hydrocarbyl chain" includes saturated and unsaturated hydrocarbyl chains which is any univalent radical derived from a hydrocarbon. Those of skill in the art will understand that hydrocarbyl chains include alkyl and alkenyl chains of varying carbon length for example from 1 carbon to 22 carbons.

As defined herein, the term "ClogP" means the logarithm to base 10 of the octanol/water partition coefficient (P). The octanol/water partition coefficient of a composition is the ratio between its equilibrium concentrations in octanol and water. Given that this measure is a ratio of the equilibrium concentration of a composition in a non-polar solvent (octanol) with its concentration in a polar solvent (water), ClogP is also a measure of the hydrophobicity of a material—the higher the ClogP value, the more hydrophobic the material. ClogP values can be readily calculated from a program called "CLOGP" which is available from Daylight Chemical Information Systems Inc., Irvine Calif., USA. Octanol/water partition coefficients are described in U.S. Pat. No. 5,578,563.

As defined herein, "essentially free of a component" means that no amount of that component is deliberately incorporated into the composition.

As defined herein, "unit dose" or "unitized dose" means an amount of the fabric enhancer composition suitable to treat one load of laundry, such as from about 0.05 grams to about 100 grams, preferably from about 10 grams to about 60 grams, preferably from about 20 grams to about 40 grams.

All measurements are performed at 25° C., unless otherwise specified.

It has importantly been found that by providing a fabric enhancer active which comprises a di-hydrocarbyl complex as defined herein, one or more of the above mentioned problems can be addressed. In particular, it has been found that the di-hydrocarbyl complex of the present invention exhibits desirable solubility properties in aqueous solution thereby decreasing the occurrences of floc formation and ultimately phase separation. One important benefit from using a di-hydrocarbyl complex as the fabric enhancer active is that sufficient softening benefits can be obtained while decreasing the factors which lead to compositional incompatibility.

It has importantly been found that one way to minimize the occurrence of compositional incompatibility problems is to delay the mixing of incompatible ingredients till the latest point possible so these ingredients do not have a chance to interact and ultimately separate. One way to minimize this interaction is to delay the introduction of the fabric softener active into the mixture till later in the making or using process by allowing the manufacturer to combine the different components of the fabric enhancer to a later stage of the supply process, or even to allow consumers to combine the components just prior to or during use. Further, it has been found that the di-hydrocarbyl complex provides for sufficient softening benefits.

Additionally, fabric enhancer compositions comprising cationic quats having two alkyl or alkenyl chains are believed to tend to stick to fabric after the wash and rinse process. These types of cationic quats are believed to be more difficult to remove in subsequent washings. One problem with excessive amounts of cationic quat build-up on laundered fabrics is that the fabrics may become hydrophobic making soil and stain removal more difficult because the anionic detergent is consumed removing the residual cationic quat. One of the benefits of the current invention is the ease of removal of softening agent from fabrics in subsequent washing. Without being bound by theory, it is believed that the anionic component and the cationic component of the di-hydrocarbyl complex is easier to remove from the fabrics in subsequent washings because the complex and the individual components are also individually soluble. Additional benefits of the current invention are believed to involve superior breathability of fabric that are critical for athletic garments, bath room towels, athletic shoes.

1. Di-Hydrocarbyl Complex

The invention comprises a fabric enhancer composition comprising a di-hydrocarbyl complex comprising a mono-hydrocarbyl quaternary ammonium component ionically bound to an anionic surfactant component, said di-hydrocarbyl complex having the structure:

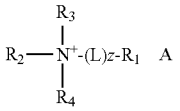

wherein $R_1$ comprises a $C_6$-$C_{18}$ hydrocarbyl chain, wherein $R_2$, $R_3$ and $R_4$ are individually selected from the group consisting of $C_1$-$C_4$ hydrocarbyl, $C_1$-$C_4$ hydroxy hydrocarbyl, —$(CH_2CH_2O)_xH$ where x has a value from about 1 to about 2, and mixtures thereof, L is a linking group selected from the group consisting of —C(O)O—, —$(CH_2CH_2O)_n$—, —C(O)—, $[CH_2CH(CH_2)O]$ and n has value of 1 to 2 with z having a value of 0 or 1, wherein $A^-$ is an anionic surfactant component comprising a $C_6$ to $C_{16}$ hydrocarbyl chain, or a $C_6$ to $C_{10}$ hydrocarbyl chain.

In one embodiment, the total amount of the mono-hydrocarbyl amido quaternary ammonium component may be greater than the total amount of anionic surfactant component as measured in mols. In one embodiment the total amount of mono-hydrocarbyl amido quaternary ammonium component to total amount of anionic surfactant may be at a mol ratio of from about 1:1 to about 50:1, or from about 1,5:1 to about 25:1, or from about 2:1 to about 5:1, or from about 3:1 to about 4:1. In one embodiment, where the fabric enhancer composition further comprises a deposition aid, it has been found that levels of the anionic surfactant can exceed the mono-hydrocarbyl quaternary ammonium component, for example from about 1:5 to about 1:1, or from about 1:3 to about 1:1.05, or from about 1:1.5 to about 1:1, while still achieving sufficient softening benefits. Those of skill in the art will understand that embodiments comprising deposition aid can also have levels of said components as high as 50:1 as described above.

Importantly, this di-hydrocarbyl complex can be formed in product on the shelf; can be formed on location by the manufacturer where the composition is marketed if the manufacturing is performed remotely, and/or can be formed in situ by the consumer just prior to or during use in the wash and/or rinse bath. It is believed that this formulation flexibility allows for reduced transportation costs as well as reduced time on shelf which can lead to potential phase separation problems. In particular, where the di-hydrocarbyl complex is formed by the manufacturer on location or by the consumer in situ, the mono-hydrocarbyl quaternary ammonium compound and the anionic surfactant can be in either powder, liquid, or gel form, or combinations thereof. Powder and/or gel forms are particularly preferred if the composition is to be transported from a centralized manufacturing location to different geographies as it reduces transportation costs. Further, by providing the mono-hydrocarbyl quaternary ammonium compound and the anionic surfactant as separate components prior to the desired point of mixing to form the di-hydrocarbyl complex, the manufacturer and/or consumer can control the relative amount of each ingredient they desire to incorporate into the fabric enhancer composition as well as the overall concentration of the complex in composition.

In one embodiment the fabric enhancer composition may be a dilute formulation comprising from about 1% to about 25%, or from about 4% to about 18%, or from about 8% to about 15% of said di-hydrocarbyl complex. In another embodiment the fabric enhancer composition may be a concentrate formulation comprising from about 25% to about 80%, or from about 30% to about 60%, or from about 35% to about 45% of said di-hydrocarbyl complex.

One important benefit obtained by the present invention is that the separate surfactant components which are used to form the di-hydrocarbyl complex can be manufactured and transported in powder or other non-liquid form allowing for decreased transportation costs when shipping product to markets overseas. Further, the ability to market the separate surfactant components in powder or other non-liquid form allows for avoidance of many of the phase separation problems encountered with conventional liquid fabric softening compositions such as reported in US Patent Publ. No 2009/0042765A1.

In one embodiment, the fabric enhancer composition may be in liquid or gel form. In another embodiment, the fabric enhancer composition may be in the form of a paste, semi-solid, suspension, powder, or any mixture thereof.

2. Mono-Hydrocarbyl Quaternary Ammonium Component

The total amount of the mono-hydrocarbyl quaternary ammonium component, in free or bound state, is from about 1% to about 80% by weight of said fabric enhancer composition, or from about 5% to about 70%, or from about 15% to about 60%, or from about 30% to about 55%. As defined herein, a bound state means that the component forms a part of the di-hydrocarbyl complex with a molecule of the other component. The mono-hydrocarbyl quaternary ammonium compound has the formula:

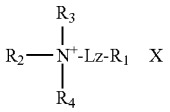

wherein $R_1$, $R_2$, $R_3$ and $R_4$ are as described above with regards to the di-hydrocarbyl complex, and wherein $X^-$ is a counter anion such as Br—, Cl—, I—, Na—, $OSO_3CH_3$—, and combinations thereof.

In forming the di-hydrocarbyl complex, an anionic surfactant forms an ionic bond with the positively charged nitrogen molecule, thereby replacing the $X^-$. Although it may be suitable to have all the anionic surfactant be consumed in forming the complex, it is not necessary. In one embodiment, only a portion of the mono-hydrocarbyl quaternary ammonium component forms the di-hydrocarbyl complex, or about 10%, or about 50%, or about 75%, or about 90%, or about 95%, or about 99%. In another embodiment, only a portion of the anionic surfactant forms the di-hydrocarbyl complex forms the di-hydrocarbyl complex, or about 10%, or about 50%, or about 75%, or about 90%, or about 95%, or about 99%.

In one embodiment the mono-hydrocarbyl amido quaternary ammonium compound is selected from the group consisting of a monoalkyl amine, a monoalkyl monomethyl amine, a monoalkyl dimethyl amine, a monoalkyl trimethyl amine, and a mixture thereof.

In one embodiment, the present invention is free or essentially free of any di-alkyl quat. In another embodiment, the fabric enhancer composition is free or essentially free of any cationic surfactant not having a structure of formula (1) as disclosed herein. In yet another embodiment, the present invention is free or essentially free of an amido imidazolinium compound.

3. Anionic Surfactant Component

The total amount of the anionic surfactant component, in free or bound state, is preferably from about 1% to about 80% by weight of said fabric enhancer composition, or from about 5% to about 70%, or from about 15% to about 60%, or from about 30% to about 55%.

Non-limiting examples of suitable anionic surfactants are a monoalkyl sulfonate, a monoalkyl benzene sulfonate, a monoalkyl ethoxylated sulfonate, a monoalkyl sulfate, a monoalkyl benzene sulfate, a monoalkyl ethoxylated sulfate, a monoalkyl carboxylate, a monoalkyl phosphate, and a mixture thereof. In one embodiment, said anionic surfactant comprises a $C_6$-$C_{18}$ anionic surfactant, preferably a $C_6$-$C_{12}$, more preferably a $C_8$-$C_{10}$ hydrocarbyl chain. In one embodiment, the number of carbons in the anionic surfactant is within 4 carbon units of the $R_1$ of the mono-hydrocarbyl amide-quaternary ammonium component, or within 2 or 1 carbon unit, or the same number of carbons. The anionic surfactant can be selected from the group consisting of: a $C_6$-$C_{18}$ alkyl benzene sulfonate surfactant; a $C_6$-$C_{18}$ branched-chain and random alkyl sulfate surfactant; a $C_6$-$C_{18}$ alkyl alkoxy sulfate surfactant, having an average degree of alkoxylation of from 1 to 30, wherein the alkoxy comprises a $C_1$ to $C_4$ chain and mixtures thereof; a mid-chain branched alkyl sulfate surfactant; a mid-chain branched alkyl alkoxy sulfate surfactant having an average degree of alkoxylation of from 1 to 30, wherein the alkoxy comprises a $C_1$ to $C_4$ chain and mixtures thereof; a $C_6$-$C_{18}$ alkyl alkoxy carboxylates comprising an average degree of alkoxylation of from 1 to 5; a $C_6$-$C_{18}$ methyl ester sulfonate surfactant, a $C_{10}$-$C_{18}$ alpha-olefin sulfonate surfactant, a $C_6$-$C_{18}$ sulfosuccinate surfactant, and a mixture thereof.

Suitable anionic surfactants for use herein include alkyl polyethoxylate sulfates, and may contain other non-soap anionic surfactants, or mixtures thereof. In one embodiment, the anionic surfactant comprises less than about 6% of an alkyl benzene sulfonate. Other useful anionic surfactants include the water-soluble salts, particularly the alkali metal, ammonium and alkylolammonium (e.g., monoethanolammonium or triethanolammonium) salts, of organic sulfuric reaction products having in their molecular structure an alkyl group containing from about 10 to about 18 carbon atoms and a sulfonic acid or sulfuric acid ester group. (Included in the term "alkyl" is the alkyl portion of aryl groups.) Examples of this group of synthetic surfactants include the alkyl sulfates, especially those obtained by sulfating the higher alcohols ($C_{8-18}$ carbon atoms) such as those produced by reducing the glycerides of tallow or coconut oil.

Other anionic surfactants herein are the water-soluble salts of: paraffin sulfonates containing from about 6 to about 18 (or about 12 to 18) carbon atoms; alkyl glyceryl ether sulfonates, especially those ethers of $C_{8-18}$ alcohols (e.g., those derived from tallow and coconut oil); alkyl phenol ethylene oxide ether sulfates containing from about 1 to about 4 units of ethylene oxide per molecule and from about 8 to about 12 carbon atoms in the alkyl group; and alkyl ethylene oxide ether sulfates containing about 1 to about 4 units of ethylene oxide per molecule and from about 6 to about 18 carbon atoms in the alkyl group.

Other useful anionic surfactants include the water-soluble salts of esters of α-sulfonated fatty acids containing from about 6 to 18 carbon atoms in the fatty acid group and from about 1 to 10 carbon atoms in the ester group; water-soluble salts of 2-acyloxy-alkane-1-sulfonic acids containing from about 2 to 9 carbon atoms in the acyl group and from about 9 to about 18 carbon atoms in the alkane moiety; water-soluble salts of olefin sulfonates containing from about 12 to 18 carbon atoms; and β-alkyloxy alkane sulfonates containing from about 1 to 3 carbon atoms in the alkyl group and from about 8 to 18 carbon atoms in the alkane moiety.

The anionic surfactant can comprise analkyl polyethoxylate sulfates of the formula:

$$RO(C_2H_4O)_xSO_3^-M^+$$

wherein R is an alkyl chain having from about 10 to about 18 carbon atoms, saturated or unsaturated, and the longest linear portion of the alkyl chain is 15 carbon atoms or less on the average, M is a cation which makes the compound water-soluble, especially an alkali metal, ammonium or substituted ammonium cation, and x is from 1 to about 15. In one embodiment, the surfactant component of the present compositions comprises from about 60% to about 100%, of the surfactant component, of an alkyl polyethoxylate sulfate, or at least about 70%, or at least about 80%.

In one embodiment, the anionic surfactant comprises a low level of alkyl benzene sulfonates, for example less than about 6%, or less than about 3%, or less than about 2%. In one embodiment, the fabric enhancer composition is free or essentially free of any alkyl benzene sulfonates, such as linear alkyl benzene sulfonates and alkyl benzene sulfonates described in U.S. Pat. No. 5,466,394 at col. 3, line 55-67.

Non-limiting examples of additional anionic surfactants suitable useful herein include some of the anionic surfactants disclosed in U.S. Pat. Nos. 4,888,119 to Klewsaat, 4,285,841 to Barrat et al., and 3,919,678 to Laughlin, et al.

In one embodiment, the fabric enhancer composition further comprises a nonionic surfactant. The compositions of the present invention may comprise up to about 30%, or from about 0.01% to about 20%, more or from about 0.1% to about 10%, by weight of the composition, of a nonionic surfactant. In one embodiment, the nonionic surfactant may comprises an ethoxylated nonionic surfactant. Examples of suitable non-ionic surfactants are provided in U.S. Pat. No. 4,285,841 to Barrat et al, and 4,284,532 to Leikhim et al. It is further believed that the addition of a nonionic surfactant to the fabric enhancer compositions of the present invention is helpful in providing physical stability to the detergent product, i.e., preventing phase splits and precipitation. This is particularly true for compositions containing levels of mono-hydrocarbyl quat above about 30 wt %, or above about 50%, or above about 70% and/or at levels of anionic surfactant below about 30%, or below about 15%, or below about 5%. In one embodiment, the fabric enhancer composition is free or essentially free of nonionic surfactant.

4. Critical Micelle Concentration ("CMC")

The surfactants suitable for the use in the present invention are preferably soluble at 25° C. in deionized water solutions. Without being bound by theory, soluble surfactants provide a pathway to create insoluble complexes; nonsoluble surfactants tend to form liquid crystals rather than micelles. The critical micelle concentration of the surfactant is one way to measure the solubility of the surfactant components.

In one embodiment the mono-hydrocarbyl cationic surfactant has a CMC (molar value) of value of from about 1 to $10^{-4}$, or from about 0.1 to $10^{-3}$. In another embodiment said mono-hydrocarbyl anionic surfactant has CMC value of from 1 to $10^{-4}$, or from about 0.1 to $10^{-3}$. CMC values can be determined from "Critical Micelle Concentrations of Aqueous Surfactant Solutions" Mukerjee and Mysels NSRDS (1970).

In one embodiment, one or both of the cationic and anionic components is soluble, meaning the component value as defined above. In one embodiment, both of the components are water soluble.

Those of skill in the art will understand that CMC as used herein means the concentration of the ingredient in deionized water where above which micelles are spontaneously formed.

In another embodiment, the mono-hydrocarbyl cationic surfactant and the mono-hydrocarbyl anionic surfactant comprises a difference in CMC value of less than about 0.1, or less than about 0.05, or less than about 0.01. Without being bound by theory, it is believed that embodiment where both components are water soluble allow the di-hydrocarbyl complex to also be water soluble allowing for decreased occurrence of phase stability problems. Further, where the differential CMC is with the value stated herein, it is believed that the composition exhibits preferred phase stability across a variety of conditions.

5. Optional Organosilicones

In one embodiment, the fabric enhancer composition further comprises an organosilicone, such as: a polyalkyl silicone, an aminosilicone, a siloxane, a polydimethyl siloxane, an ethoxylated organosilicone, a propoxylated organosilicone, an ethoxylated/propoxylated organosilicone, and mixtures thereof. In one embodiment, the organosilicone is cationic, such as an amino functional organosilicone.

Organosilicones not only provide softness and smoothness to fabrics, but also provide a substantial color appearance benefit to fabrics, especially after multiple laundry washing cycles. While not wishing to be bound by theory, it is believed that organosilicones provide an anti-abrasion benefit to fabrics in the washing or rinse cycles of an automatic washing machine by reducing friction of the fibers. Suitable polymers for use herein are described in US Patent Publ. No. 2006/0217288 A1 to Wahl et al. at ¶¶ 11-27.

In one embodiment, the fabric enhancer composition is a concentrated composition comprising from about 5% to about 90%, or from about 8% to about 70%, or about 9% to about 30%, or from about 10% to 25%, or from about 15% to about 24%, polymer by weight of the fabric enhancer composition. In another embodiment, the fabric enhancer composition is a non-concentrated composition comprising from about 2% to about 30%, or from about 3% to about 20%, or from about 4% to about 10% of polymer.

Suitable organosilicones comprise Si—O moieties and may be selected from (a) non-functionalized siloxane polymers, (b) functionalized siloxane polymers, and combinations thereof. The molecular weight of the organosilicone is usually indicated by the reference to the viscosity of the material. In one aspect, the organosilicones may comprise a viscosity of from about 10 to about 2,000,000 centistokes at 25° C. In another aspect, suitable organosilicones may have a viscosity of from about 10 to about 800,000 centistokes at 25° C. Suitable organosilicones may be linear, branched or cross-linked. In one aspect, the organosilicones may be linear.

In one aspect, the organosilicone may comprise a non-functionalized siloxane polymer that may have Formula I below, and may comprise polyalkyl and/or phenyl silicone fluids, resins and/or gums.

$$[R_1R_2R_3SiO_{1/2}]_n[R_4R_4SiO_{2/2}]_m[R_4SiO_{3/2}]_j \quad \text{(Formula I)}$$

wherein: i) each $R_1$, $R_2$, $R_3$ and $R_4$ may be independently selected from the group consisting of H, —OH, $C_1$-$C_{20}$ alkyl, $C_1$-$C_{20}$ substituted alkyl, $C_6$-$C_{20}$ aryl, $C_6$-$C_{20}$ substituted aryl, alkylaryl, and/or $C_1$-$C_{20}$ alkoxy, moieties; ii) n may be an integer from about 2 to about 10, or from about 2 to about 6; or 2; such that n=j+2; iii) m may be an integer from about 5 to about 8,000, from about 7 to about 8,000 or from about 15 to about 4,000; and iv) j may be an integer from about 0 to about 10, or from about 0 to about 4, or 0.

In one aspect, $R_2$, $R_3$ and $R_4$ may comprise methyl, ethyl, propyl, $C_4$-$C_{20}$ alkyl, and/or $C_6$-$C_{20}$ aryl moieties. In one aspect, each of $R_2$, $R_3$ and $R_4$ may be methyl. Each $R_1$ moiety blocking the ends of the silicone chain may comprise a moiety selected from the group consisting of hydrogen, methyl, methoxy, ethoxy, hydroxy, propoxy, and/or aryloxy.

As used herein, the nomenclature SiO"n"/2 represents the ratio of oxygen and silicon atoms. For example, $SiO_{1/2}$ means that one oxygen is shared between two Si atoms. Likewise $SiO_{2/2}$ means that two oxygen atoms are shared between two Si atoms and $SiO_{3/2}$ means that three oxygen atoms are shared are shared between two Si atoms.

In one aspect, the organosilicone may be polydimethylsiloxane, dimethicone, dimethiconol, dimethicone crosspolymer, phenyl trimethicone, alkyl dimethicone, lauryl dimethicone, stearyl dimethicone and phenyl dimethicone. Examples include those available under the trade names DC 200 Fluid, DC 1664, DC 349, DC 346G available from offered by Dow Corning Corporation, Midland, Mich., and those available under the trade names SF1202, SF1204, SF96, and Viscasil® available from Momentive Silicones, Waterford, N.Y.

In one aspect, the organosilicone may comprise a cyclic silicone. The cyclic silicone may comprise a cyclomethicone of the formula $[(CH_3)_2SiO]_n$ where n is an integer that may range from about 3 to about 7, or from about 5 to about 6.

In one aspect, the organosilicone may comprise a functionalized siloxane polymer. Functionalized siloxane polymers may comprise one or more functional moieties selected from the group consisting of amino, amido, alkoxy, hydroxy, polyether, carboxy, hydride, mercapto, sulfate phosphate, and/or quaternary ammonium moieties. These moieties may be attached directly to the siloxane backbone through a bivalent alkylene radical, (i.e., "pendant") or may be part of the backbone. Suitable functionalized siloxane polymers include materials selected from the group consisting of aminosilicones, amidosilicones, silicone polyethers, silicone-urethane polymers, quaternary ABn silicones, amino ABn silicones, and combinations thereof.

In one aspect, the functionalized siloxane polymer may comprise a silicone polyether, also referred to as "dimethicone copolyol." In general, silicone polyethers comprise a polydimethylsiloxane backbone with one or more polyoxyalkylene chains. The polyoxyalkylene moieties may be incorporated in the polymer as pendent chains or as terminal blocks. Such silicones are described in USPA 2005/0098759, and U.S. Pat. Nos. 4,818,421 and 3,299,112. Exemplary commercially available silicone polyethers include DC 190, DC 193, FF400, all available from Dow Corning Corporation, and various Silwet surfactants available from Momentive Silicones.

In another aspect, the functionalized siloxane polymer may comprise an aminosilicone. Suitable aminosilicones are described in U.S. Pat. Nos. 7,335,630 B2, 4,911,852, and USPA 2005/0170994A1. In one aspect the aminosilicone may be that described in USPA 61/221,632. In another aspect, the aminosilicone may comprise the structure of Formula II:

$$[R_1R_2R_3SiO_{1/2}]_n[(R_4Si(X—Z)O_{2/2}]_k[R_4R_4SiO_{2/2}]_m[R_4SiO_{3/2}]_j \quad \text{(Formula II)}$$

wherein i. $R_1$, $R_2$, $R_3$ and $R_4$ may each be independently selected from H, OH, $C_1$-$C_{20}$ alkyl, $C_1$-$C_{20}$ substituted alkyl, $C_6$-$C_{20}$ aryl, $C_6$-$C_{20}$ substituted aryl, alkylaryl, and/or $C_1$-$C_{20}$ alkoxy;

ii. Each X may be independently selected from a divalent alkylene radical comprising 2-12 carbon atoms, —$(CH_2)$s- wherein s may be an integer from about 2 to about 10; —

$$CH_2—CH(OH)—CH_2—; \text{ and/or}$$

$$—CH_2—\overset{CH_3}{\overset{|}{CH}}—CH_2—;$$

iii. Each Z may be independently selected from —$N(R_5)_2$; —$N(R_5)_3A^-$, $$—\overset{R_5}{\overset{|}{N}}—X—\overset{R_5}{\overset{|}{N}}—R_5 \quad \text{or}$$

-continued

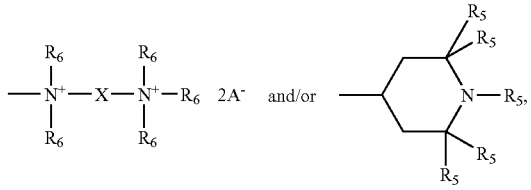

wherein each $R_5$ may be selected independently selected from H, $C_1$-$C_{20}$ alkyl, $C_1$-$C_{20}$ substituted alkyl, $C_6$-$C_{20}$ aryl, $C_6$-$C_{20}$ and/or substituted aryl, each $R_6$ may be independently selected from H, OH, $C_1$-$C_{20}$ alkyl, $C_1$-$C_{20}$ substituted alkyl, $C_6$-$C_{20}$ aryl, $C_6$-$C_{20}$ substituted aryl, alkylaryl, and/or $C_1$-$C_{20}$ alkoxy; and $A^-$ may be a compatible anion. In one aspect, $A^-$ may be a halide;

iv. k may be an integer from about 3 to about 20, preferably from about 5 to about 18 more preferably from about 5 to about 10;

v. m may be an integer from about 100 to about 2,000, or from about 150 to about 1,000;

vi. n may be an integer from about 2 to about 10, or about 2 to about 6, or 2, such that n=j+2; and vii. j may be an integer from about 0 to about 10, or from about 0 to about 4, or 0.

In one aspect, $R_1$ may comprise —OH. In this aspect, the organosilicone is amodimethicone. Exemplary commercially available aminosilicones include DC 8822, 2-8177, and DC-949, available from Dow Corning Corporation, and KF-873, available from Shin-Etsu Silicones, Akron, Ohio.

In one aspect, the organosilicone may comprise amine ABn silicones and quat ABn silicones. Such organosilicones are generally produced by reacting a diamine with an epoxide. These are described, for example, in U.S. Pat. Nos. 6,903,061 B2, 5,981,681, 5,807,956, 6,903,061 and 7,273,837. These are commercially available under the trade names Magnasoft® Prime, Magnasoft® JSS, Silsoft® A-858 (all from Momentive Silicones). In another aspect, the functionalized siloxane polymer may comprise silicone-urethanes, such as those described in USPA 61/170,150. These are commercially available from Wacker Silicones under the trade name SLM-21200. When a sample of organosilicone is analyzed, it is recognized by the skilled artisan that such sample may have, on average, non-integer indices for Formula I and II above, but that such average indice values will be within the ranges of the indices for Formula I and II above.

5. Optional Deposition Aid

In one embodiment of the present invention, the fabric enhancer composition further comprises a deposition aid. In one embodiment, the deposition aid is a cationic polymer, which can interact with the anionic surfactant to form a portion of the coacervate. As defined herein, the optional deposition aid does not include any organosilicone provided in the composition. While not to be bound by theory, it is believed that the coacervate sweeps up small droplets of the mono-hydrocarbyl quat, and any other fabric benefit agents such as silicone, in the wash and helps deposit them to the fabric surface. For example, the use of a cationic guar gum and anionic surfactant as a coacervate may effectively increase the deposition efficiency of the mono-hydrocarbyl quat and/or organosilicone deposited on the fabrics from an STW composition of the present invention. The coacervate also may help prevent the mono-hydrocarbyl quat or organosilicone from being rinsed off the fabrics in the rinse cycle.

It has surprisingly been found that the addition of the deposition aid into the fabric enhancer composition of the present invention allows for enhanced softness benefits. Without being bound by theory, it is believed that since the di-hydrocarbyl complex has cationic and anionic components, the resultant complex may have a net neutral charge. As such, it may be particularly useful to include a deposition aid to assist in the deposition of the di-hydrocarbyl complex onto the fabrics during laundering. In embodiments where a deposition aid is not included, it may be desirable to include a relatively higher amount of the cationic component in the composition to provide a net positive charge in the overall formulation such that suitable deposition is possible.

The fabric enhancer compositions herein can contain from about 0.001% to about 12%, or from about 0.01% to about 5%, or from about 0.1% to about 2%, of deposition aid. In one embodiment, the deposition aid has a molecular weight of from about 500 to about 5,000,000, or from about 1,000 to about 2,000,000, or from about 1,000 to about 1,000,000, and or from about 2,000 to about 500,000. In another embodiment, the deposition aid has a charge density of at least about 0.01 meq/gm., and up to about 23 meq/gm., or from about 0.05 to about 8 meq/gm., or from about 0.08 to about 7 meq/gm., and even or from about 0.1 to about 1 meq/gm.

Suitable deposition aids include amine salts; quaternary ammonium salts; derivatives of natural polymers such as some polysaccharide, gums, starch and certain cationic synthetic polymers such as polymers and copolymers of cationic vinyl pyridine or vinyl pyridinium halides.

In one embodiment, the polymers are water-soluble, for instance to the extent of at least 0.5% by weight are soluble in water at 20° C. In another embodiment, the polymers have molecular weights (Daltons) of from about 500 to about 5,000,000, or from about 1,000 to about 2,000,000, or from about 1,000 to about 1,000,000, or from about 2,000 to about 500,000, or from about 2000 to about 100,000. In one embodiment, the cationic polymers have a charge density of at least about 0.01 meq/gm., or from about 0.05 to about 8 meq/gm., or from about 0.08 to about 7 meq/gm., or from about 0.1 to about 1 meq/gm.

In one embodiment, the deposition aid comprises a polysaccharide gum, such as Xanthan Gum; Ghatti Gum; Tamarind Gum; Gum Arabic; and Agar; a cationic guar gum; and a galactomannam gums such as guar and locust bean gums. In another embodiment, the deposition aid comprises a cationic polysaccharide or starch, and derivatives thereof. Suitable cationic starches include natural starches such as those obtained from maize, wheat, barley etc., and from roots such as potato, tapioca etc., and dextrins, particularly the pyrodextrins such as British gum and white dextrin. Suitable cationic polysaccharides are described in US Pat. Publ. 2004/0204337 and 2006/0276370.

Cationic Polysaccharides

The compositions of the present invention also contain cationic polysaccharides. As used herein, the term "cationic polysaccharide" refers to a polysaccharide that has been chemically modified to provide the polysaccharide with a net positive charge in a pH neutral aqueous medium.

The non-modified polysaccharides can be extracted from a variety of sources including plant sources (such as tubers, legumes, seeds, grains and algaes), animal sources, or produced by organisms (such as bacteria, fungi, prokaryotes, and eukaryotes). Suitable polysaccharides from these sources include, but are not limited to, starch, cellulose, pectin, carageenan, guar gums, xanthans, dextrans, curdlans, chitosan, chitin, and the like. The chemical modification to impart net positive charge to the polysaccharides includes, but is not limited to, the addition of amino and/or ammonium group(s) into the polysaccharides molecules. These quaternary ammonium substituents may be introduced into the polysaccharides via reactions with such as trimethylhydroxypropyl ammonium chloride, dimethylstearylhydroxypropyl ammonium chloride, or dimethyldodecylhydroxypropyl ammonium chloride.

In one embodiment of the present invention, the cationic polysaccharide is an ammonium quaternary substituted polysaccharide having a net charge density (expressed as meq of nitrogen per gram of cationic polysaccharide) from about 0.05 to about 5.5 meq/gram, or from about 0.05 to about 3 meq/gram, and more or from about 0.05 to about 0.6 meq/gram. The charge density of an ammonium quaternary substituted polysaccharide may be expressed in terms of weight percentage of N in the polymer, or in terms of meq/gram. The conversion factors between these two expressions are as following: 1 wt % N=0.71 meq/gram, or 1.0 meg/gram=1.4 wt % N.

The cationic polysaccharide in the composition of the present invention may include one or more additional modifications. For example, these modifications may include cross-linking, stabilization reactions (such as alkylation and esterification), phosphorylations, hydrolyzations.

In one embodiment of the composition of the present invention, the cationic polysaccharide is a hydrolyzed cationic starch. A suitable method of hydrolyzing starch is described by U.S. Pat. No. 4,499,116, with specific mention at column 4.

The fabric care composition may optionally comprise deposition agents including, but not limited to, I) non-quaternary materials that are (a) acyclic polymers or copolymers having nitrogen moieties in the backbone or in the pendant groups, or (b) vinyl polymers or copolymers having nitrogen heterocyclics in the pendant groups; II) non-polysaccharide polyquaterniums and other polymeric cationic quaternary materials; and mixtures thereof.

The deposition agents suitable for use herein are polymeric materials with a molecular weight generally in one of the following the ranges: from about 1000 to about 1,000,000 daltons, or from about 1000 to about 200,000 daltons, or from about 2500 to about 1,000,000 daltons, or from about 5000 to about 500,000 daltons. In one embodiment, the deposition agent is polyacrylamide or derivatives thereof, and the molecular weight of the deposition agent ranges from about 1,000,000 to about 15,000,000 daltons.

In some embodiments of the present invention, suitable deposition agents are acyclic polymers or copolymers derived from monomers having nitrogen moieties, including but not limited to, amine, imine, amide, imide, acrylamide, methacrylamide, amino acid, and mixtures thereof. These and other deposition aids are described in additional detail in US Patent Publ. No. 2006/0276370. Nonlimiting examples of suitable deposition agents are described below:

Acrylic Polymers or Copolymers Having Nitrogen Moieties

In one embodiment, the composition comprises one or more of the following acrylic polymers or copolymers having nitrogen moieties: polyvinylamine; polyethyleneimine; grafted and crosslinked polyAmido-polyethyleneimine; ethoxylated polyethyleneimine; polyacrylamide; poly(2-dimethylaminoethyl methacrylate); poly(amino acids); polylysine aminocaproic acid derivatives; and mixtures thereof.

Vinyl Polymers or Copolymers Having Nitrogen Heterocyclic Pendant Moieties

In some embodiments of the present invention, suitable deposition agents are vinyl polymers or copolymers derived from vinyl monomers with nitrogen heterocyclic pendant moieties having the general formula:

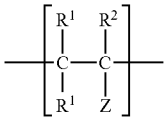

wherein $R^1$, $R^2$ are independently hydrogen, halogen, linear or cyclic, saturated or unsaturated C1-C4 alky or alkoxy, substituted or unsubstituted phenyl, benzyl, naphthayl or heterocyclics, and mixtures thereof; Z is nitrogen heterocyclics, including nitrogen heterocyclic N-oxides. Nonlimiting examples of these deposition agents are: polyvinylpyrrolidone (PVP); polyvinylpyridine; polyvinylpyridine-N-oxide (PVNO); polyvinylpyrrolidone vinyl imadazole (PVPVI); copolymers of vinylpyrrolidone and dimethylaminoethyl methacrylate; and combinations thereof.

Non-Polysaccharide Polyquaterniums and Other Polymeric Cationic Quaternary Materials In some embodiments of the present invention, suitable deposition agents are non-polysaccharide polyquaterniums, other polymeric cationic quaternary materials or mixtures thereof. As used herein, the term "Polyquaternium-x" has the same meaning as defined in INCI (International Nomenclature Cosmetic Ingredient). These cationic quaternary materials can be paired with anions, including but not limited to halides or $SO_3CH_3^-$. Nonlimiting examples of these deposition agents are described below:

a) Polyquaternium-2;
b) Polyquaternium-6 (N,N-dimethyl-N-2-propen-1-ammonium chloride homo-polymer);
c) Polyquaternium-7 (copolymer of acrylamide and N,N-dimethyl-N-2-propen-1-ammonium chloride);
d) Polyquaternium-11 (quaternized poly(vinylpyrrolidone/dimethylaminoethyl acrylate);
e) Polyquaternium-16 (copolymer of polyvinylpyrrolidone and imidazolinium methylchloride);
f) Polyquaternium-17: examples of this polymeric material are available as Mirapol® AD-1;
g) Polyquaternium-18: examples of this polymeric material are available as Mirapol® AZ-1;
h) Polyquaternium-22 (copolymer of sodium acrylate and dimethyl diallyl ammonium chloride);
i) Polyquaternium-28 (copolymer of vinylpyrrolidone and methacrylate amidopropyl/trimethylammonium chloride);
j) cationic polyacrylamide;
k) poly(2-acryloyloxyethyl)trimethylammonium cation;
l) polymethacrylamidopropyl trimethylammonium cation;
m) copolymers containing polyamide, polyether and polyethylenimine;

and combinations thereof.

Additional suitable cationic polymers for use as deposition aids are disclosed in detail in U.S. Pat. No. 6,492,322 at col. 6, line 65 to col. 24, line 24; US Patent Publs. 2003/0139312 A1 at ¶¶ 317-47 and 2006/0217288 A1 to Wahl et al., at ¶¶ 61-84, section entitled "Cationic Polymers"; and in the CTFA "International Cosmetic Ingredient Dictionary and Handbook," Tenth Edition, Tara E. Gottschalck and Gerald N. McEwen, Jr., editors, published by The Cosmetic, Toiletry, and Fragrance Association, 2004. In one embodiment, the fabric enhancer composition is free or essentially free of a deposition aid.

7. Perfume

In one embodiment, the fabric enhancer composition comprises a perfume at a level of at least about 0.001%, or at least about 0.01%, or at least about 0.1%, to about 10%, or to about 5%, or to about 3%, by weight. In one embodiment, the perfume of the fabric conditioning composition of the present invention comprises an enduring perfume ingredient(s) that have a boiling point of about 250° C. or higher and a ClogP of about 3.0 or higher, or at a level of at least about 25%, by weight of the perfume. Suitable perfumes, perfume ingredients, and perfume carriers are described in U.S. Pat. No. 5,500,138; and US 2002/0035053 A1. In another embodiment, the perfume comprises a perfume microcapsule and/or a perfume nanocapsule. Suitable perfume microcapsules and nanocapsules include those described in the following references: US 2003215417 A1; US 2003216488 A1; US 2003158344 A1; US 2003165692 A1; US 2004071742 A1; US 2004071746 A1; US 2004072719 A1; US 2004072720 A1; EP 1393706 A1; US 2003203829 A1; US 2003195133 A1; US 2004087477 A1; US 20040106536 A1; U.S. Pat. No. 6,645,479; U.S. Pat. No. 6,200,949; U.S. Pat. No. 4,882,220; U.S. Pat. No. 4,917,920; U.S. Pat. No. 4,514,461; U.S. RE 32713; U.S. Pat. No. 4,234,627.

In yet another embodiment, the fabric enhancer composition of the present invention comprises odor control agents. Such agents include those described in U.S. Pat. No. 5,942,217: "Uncomplexed cyclodextrin compositions for odor control", granted Aug. 24, 1999. Other agents suitable odor control agents include those described in the following: U.S. Pat. No. 5,968,404, U.S. Pat. No. 5,955,093; U.S. Pat. No. 6,106,738; U.S. Pat. No. 5,942,217; and U.S. Pat. No. 6,033,679.

In one embodiment, the fabric enhancer composition further comprises an additional particulate component comprising a perfume. Examples of suitable particulate components which can be added to the present composition include perfume loaded porous carrier components such as zeolites and clays as disclosed in EP 931130; EP 0110311, EP 1388585, and EP 851191; laundry active delivery particles comprising encapsulated actives such as perfume as described in U.S. Ser. No. 12/369,980 to Nigel Sommerville Roberts, and functionalized substrates comprising perfume microcapsules which can be in confetti form as disclosed in paragraphs 146-148 of US 2008/0014393. Other perfume carrier particles can also be used, such as disclosed in U.S. Pat. No. 7,049,274 to Renade (perfume film chips) and U.S. Pat. No. 4,209,417 to Whyte (perfume particles comprising water soluble polymer, perfume and emulsifier). Nonlimiting examples of additional suitable particulate components for delivery perfume are disclosed in WO04083356A (particulate carrier components comprising perfume and a water soluble salt of an alkali or alkaline earth metal); WO 05005591A1 (e.g. perfume loaded fragrance carrier materials comprising clay, silicas, phosphates and/or acrylates and fragrance carrier such as polyethylene glycols); WO 08009521A1 to Artiga et al; and U.S. Pat. No. 6,803,033, to McGee.

6. Wafer Content

The water content of the present fabric enhancer composition depends upon the desired product form. In one embodiment, where the composition is in powder form, the water content can be below about 5%, or below about 1%, or below about 0.1% of water. In another embodiment, where the composition is a gelled or concentrated form such as a paste, the composition comprises from about 5% to about 40% of water, or from about 8% to about 15%. In another embodiment, where the composition is a liquid form, the composition comprises from about 40% to about 95% of water. Those of skill will understand that where the composition is marketed as a unit dose composition water soluble pouch, which can be a single or multiple compartment execution with the monohydrocarbyl quaternary ammonium component and anionic surfactant in liquid, powder or combinations of physical forms, the water content of any liquid or gelled component may beneficially be below about 15%, or below about 10%, or below about 5% water to avoid potential dissolving or degredation of the pouch materials.

7. Adjunct Components a. Thickeners and Structurants

Compositions of the present invention may contain a structurant or structuring agent. Structurants can also build viscosity to produce a useful liquid gel product form. Suitable levels of this component are in the range from about 0% to 20%, or from 0.1% to 10%, and or from 0.1% to 3% by weight of the fabric enhancer composition. The structurant serves to stabilize the organosilicone in the inventive compositions and to prevent it from coagulating and/or creaming. This is especially important when the inventive compositions have fluid form, as in the case of liquid or the gel-form fabric enhancer compositions.

Structurants suitable for use herein include thickening stabilizers. These include gums and other similar polysaccharides, for example gellan gum, carrageenan gum, xanthan gum, Diutan gum (ex. CP Kelco) and other known types of thickeners and rheological additives such as Rheovis CDP (ex. Ciba Specialty Chemicals), Alcogum L-520 (ex. Alco Chemical), and Sepigel 305 (ex. SEPPIC). Suitable structurants are described in US Patent Publ. 2006/0217288.

b. Additional Components

The fabric enhancer compositions of the present invention may comprise one or more optional ingredients typically included in laundry detergent and/or softener compositions. In yet another embodiment, the composition is free or substantially free of one or more optional ingredients. Typical optional ingredients include, but are not limited to fatty acids, clays, colorants, huing dyes, brighteners, flow aids, antibacterial agents, bleach, chelants, heavy metal sequestering agents, builders, electrolytes, malodor control agents, shape retention polymers, anti-abrasion agents, dye fixatives, dye transfer inhibition agents, anti-wrinkling agents and so forth. Non-limiting examples of suitable optional ingredients are provided in U.S. Pat. No. 6,958,313 to Caswell et al. and US Patent Publ. 2006/0217288.

Other suitable adjunct materials include, but are note limited to, preservatives such as benzyl alcohol, methyl paraben, propyl paraben and imidazolidinyl urea; suspending agents such as magnesium/aluminum silicate; sequestering agents such as disodium ethylenediamine tetraacetate; and certain synthetic or naturally-derived oils and/or fats, such as certain triglycerides, mineral oils, and mixtures thereof. Specific examples of oils or fats suitable for use herein as adjunct materials include, but are not limited to, triglycerides from beef tallow, palm oil, cottonseed oil, canola oil, and soybean oil, all with varying levels of hydrogenation, paraffin oils, and mixtures thereof. Additional adjunct materials further include, but are not limited to, wrinkle releasing/prevention agent, anti-static agent, crystal modifier, soil release/prevention agent, colorant, brightener, odor reducer/eliminator, deodorizer/refresher agent, stain repellent, color enhancer, perfume release and/or delivery agent, shape retention agent, fiber rebuild agent, fiber repair agent, and mixtures thereof. Additional examples of suitable adjuncts and levels of use are found in U.S. Pat. No. 6,653,275.

In one embodiment, the fabric enhancer composition further comprises a suds suppressor system at level from about 0.001% to about 10%, or from about 0.01% to about 5%, or from about 0.012% to about 1%, or from about 0.05% to about 2% by weight of the fabric care composition. Non-limiting examples of a suds suppressor (or "suds suppressing systems") is detailed in U.S. Pat. Pub. No. 2003/0060390 A1, to Demeyere et al., published Mar. 27, 2003, at paragraphs 65-77. In one embodiment of the invention, the composition of the present invention comprises suds suppressor comprising an organopolysiloxane together with a silicone resin. In another embodiment, the composition comprises an organopolysiloxane without a silicone resin. Optionally, the organopolysiloxane is linear. The silicone resin may be optionally a silicate. In turn, the silicate may be optionally modified. A nonlimiting example of a silicate modification is end-capping the silicate with one or more trimethylsiloxy groups.

In a second embodiment, the suds suppressor is a silicone comprising emulsion that is dispersed in the fabric softener composition. In a third embodiment, the composition comprising an amount of a suds suppressor such that when the composition is dosed in a rinse bath solution, a parts per million (ppm) of from 50 to 500, or from 100 to 400 ppm, or from 120 to 250 ppm, or from 150 to 200 ppm of said suds suppressor is achieved in the rinse bath solution. The silicone suds suppressor typically has a median particle size of at least about 6 microns, or at least about 8 microns, or at least about 10 microns, and or at least about 15 microns; and typically a median particle size less than about 500 micron, or less than about 100 micron.

In another embodiment of the invention, the composition further comprises a cationic care polymer, optionally at a level of from about 0.2% to about 5% by weight of the composition, or from about 0.3% to about 2%, or from about 0.5% to about 1.5%, or from about 2% to about 4.5%, or from about 2.5% to about 4%, or at least about 0.5% cationic polymer, or at least about 1%, or at least about 2%. Suitable cationic care polymers have a weight average molecular weight of at least about 5K Daltons, or at least about 10K Daltons, or at least about 35K Daltons to about 200K Daltons, or to about 150K Daltons, or to about 100K Daltons, or to about 50K Daltons, as determined by size exclusion chromatography relative to polyethyleneoxide standards with RI detection. Also, suitable are cationic care polymers having charge density about 1 meq/gram to about 25 meq/gram at a fabric care composition pH of from about 3 to about 9, or from about 2 meq/gram to about 20 meq/gram, or about 3 meq/gram to about 15 meq/gram, or up to about 9 meq/gram. See U.S. Pat. No. 6,797,688 to Cooper.

In one aspect, the cationic care polymer has a weight average molecular weight less than about 37K Daltons and a charge density of greater than about 5 meq/gram. Another group of useful synthetic cationic polymers includes those produced by polymerization of ethylenically unsaturated monomers using a suitable initiator or catalyst. These are disclosed in WO 00/56849 and U.S. Pat. No. 6,642,200 to Panandiker and U.S. Pat. No. 6,797,688 to Cooper. Another group of useful synthetic cationic care polymers are polyethyleneimine and its derivatives. A third group of useful synthetic cationic care polymers are alkylamine-epichlorohydrin polymers which are reaction products of amines and oligoamines with epicholorohydrin, for example, those polymers listed in, for example, U.S. Pat. Nos. 6,642,200 and 6,551,986, and Cartafix CB and TSF from Clariant. A fourth group of useful synthetic cationic care polymers are polyamidoamine-epichlorohydrin resins which are condensation products of polyalkylenepolyamine with polycarboxylic acid.

10. Unitized Dosing

One aspect of the invention provides an article comprising a water-soluble film and a unitized dose of a fabric enhancer composition in accordance with the present invention, wherein the fabric enhancer composition according to the present invention wherein said fabric enhancer composition is at least partially encapsulated by one or more layers of a water-soluble film.

When a unit dose of a fabric enhancer composition of the present invention is added to an aqueous bath in a typical automatic washing machine basin having a volume from about 64 L to about 75 L of water, the unitized dose forms a ppm concentration which is calculated by dividing the milligrams of the di-hydrocarbyl complex of the fabric enhancer composition by the grams of water in aqueous bath. For example, where the fabric enhancer composition is a 50 gram unit dose, said ppm of di-hydrocarbyl complex is about 330 ppm to about 400 ppm, or from about 10 ppm to about 1400 ppp, or from about 50 ppm to about 300 ppm, or from about 100 ppm to about 200 ppm.

In one embodiment, the water-soluble film forms a single compartment pouch. In another embodiment, the water-soluble film forms a multi-component pouch. In one embodiment comprising a multi-compartment pouch, the multi-compartment pouch comprises a first compartment containing said cationic surfactant component of the present invention; and a second compartment containing said anionic surfactant component. It should be understood that in this multi-compartment embodiment, the separate cationic and anionic surfactant components need not form the complex when on the shelf but will form the complex upon combination by the end user when they return home or immediately prior to use or during use in the wash or rinse bath solution of a laundry machine.

a. Water-Soluble Film

In one embodiment, the fabric enhancer composition is contained in a film article. The film is suitably water-soluble, i.e. made of polyvinyl alcohol, hydroxypropyl methyl cellulose, methyl cellulose, non-woven polyvinyl alcohols, PVP and gelatins or mixtures be used to encapsulate the fabric enhancer compositions. Polyvinyl alcohol films are commercially available from a number of sources i.e. MonoSol LLC of Gary, Ind.; Nippon Synthetic Chemical Industry Co. Ltd. Of Osaka Japan; and Ranier Specialty Chemicals of Yakima, Wash. These films may be used in varying thicknesses ranging from about 20 to about 80 microns, or from about 25 to about 76 microns (being especially suitable for rapid dissolution in a cold water wash). Where larger volumes of composition used, i.e., volumes exceeding about 25 ml, a thicker film may be used. Further, it is suitable that the films be printable and colored.

Articles such as pouches, pillows, sachets, beads, or envelopes are manufactured by heat-sealing multiple sheets together at their edges, leaving an opening for inserting the fabric enhancer composition. Examples of suitable processes for forming unit dose articles can be found in U.S. Pat. No. 6,281,183 B1, EP1126070, WO0183668, WO0183669, WO0185898, WO0183661, WO0183657, WO0183667, WO0185892, WO00208380, WO0212432, WO0220361, WO0240351, WO00183658, WO0240370, WO0160966, WO02060758, WO02060980, WO02074893, WO02057402, WO03008513, WO03008486, WO03031266, WO03045812, WO03045813, WO02060757, EP1354939, EP1375351, EP1396440, EP1431383, EP1431384, EP1340692, WO04085586, and WO 97/35537.

During the manufacture of a unit dose with a film, for example PVOH, it is useful to leave an air bubble in the pouch of a liquid composition. The air bubble is formed by slightly under filling the liquid composition into the pouch as it is being formed, for example, by vacuum. This helps prevent the liquid composition from contacting the sealing area of the film, for example when a second film is placed over the first film that is holding the liquid composition. The air bubble is from about 0.1 ml to about 10 ml in volume, or from about 0.5 ml to about 5 ml. The air bubble also is a good aesthetic visual signal for the consumer that the filled pouch actually contains a liquid composition. As a visual signal, the bubble should be from about 1 mm to about 20 mm in diameter, or from about 3 mm to about 10 mm.

The film article can be a single or multi-compartment pouch. A dual compartment article, for example a dual compartment unit dose made form PVOH film, can be comprised of the same or 2 different forms, for example a liquid/powder, a liquid/liquid, and a gel/powder. Similar combinations for forms can be used when the composition is packaged in a bottle or container.

b. Plasticizers

For compositions intended to be enclosed or encapsulated by a film, especially a highly water-soluble film like polyvinyl alcohol, it is desirable to incorporate the same or similar plasticizers found in the film into the fabric enhancer composition. This helps reduce or prevent migration of the film plasticizers into the fabric enhancer composition. Loss of plasticizers from the film can cause the article to become brittle and/or lose mechanical strength over time. Typical plasticizers to include in the highly concentrated fabric enhancer composition are glycerin, sorbitol, 1,2 propanediol, polyethylene glycols (PEGs), and other diols and glycols and mixtures. Compositions should contain from at least about 0.1%, or at least about 1%, or at least about 5% to about 70% plasticizer or mixture of plasticizers.

c. Water Content

In one embodiment, where a water-soluble film encapsulates the fabric enhancer composition, the level of water in highly concentrated fabric enhancer composition is from about 0% to about 15% of water, or less than about 13%, or less than about 10%, or less than about 5%, or even about zero, or from about 1% to about 15%, by weight of the composition. Generally, some water is useful, for example from about 8% to about 12% to prevent rigidity of a water soluble film. Higher water levels, however, can cause the water soluble films used to encapsulate said compositions of the present invention to leak or start to dissolve or disintegrate prematurely, either in the manufacturing process, during shipping/handling, or upon storage. It has been found that a low level of water can be desirable as medium for adding water-soluble dyes to the composition to give it an attractive color and to distinguish between compositions with different perfumes and/or added fabric care benefits, and to effectively hydrate a polymer and/or a structuring agent.

In another embodiment, the level of water in the fabric enhancer composition is relatively high, for example at least about 50%, or at least about 60%, or at least about 70% water. These are generally for packaging in a single compartment plastic bottle or container, or in a dual compartment, dual pour plastic bottle or container combined with another fabric care composition, for example, a liquid detergent or bleach.

a. Solvent

Solvents are useful for fluidizing the fabric enhancer compositions of the present invention, and may provide good dispersibility, and in some embodiments, provide a clear or translucent composition. Suitable solvents of the present invention can be water-soluble or water-insoluble. In one embodiment, the fabric enhancer composition further comprises from about 30% to about 70% of a solvent, or from about 45% to about 60%. In one embodiment, the solvent comprises a polyethylene glycol, glycerin, propylene glycol, and mixtures thereof. It is believed that where the fabric enhancer composition is encapsulated in a water-soluble film, higher levels of solvent are suitable in lower water levels.

Additional non-limiting examples of solvents include ethanol, propanol, isopropanol, n-propanol, n-butanol, t-butanol, propylene glycol, 1,3-propanediol, ethylene glycol, diethylene glycol, dipropylene glycol, 1,2,3-propanetriol (glycerol), propylene carbonate, phenylethyl alcohol, 2-methyl 1,3-propanediol, hexylene glycol, sorbitol, polyethylene glycols, 1,2-hexanediol, 1,2-pentanediol, 1,2-butanediol, 1,4 butanediol, 1,4-cyclohexanedimethanol, pinacol, 1,5-hexanediol, 1,6-hexanediol, 2,4-dimethyl-2,4-pentanediol, 2,2,4-trimethyl-1,3-pentanediol (and ethoxylates), 2-ethyl-1,3-hexanediol, phenoxyethanol (and ethoxylates), glycol ethers such as butyl carbitol and dipropylene glycol n-butyl ether, ester solvents such as dimethyl esters of adipic, glutaric, and succinic acids, hydrocarbons such as decane and dodecane, glycerine carbonate, and mixtures or combinations thereof. In one embodiment, the composition is free or substantially free of one or more of the above-identified solvents. Additional suitable solvents are disclosed in U.S. Pat. No. 6,958,313 and US Patent Publ. 2006/0217288.

Those of skill in the art will understand that the fabric enhancer composition can also be contained in a single or multiple compartments pour or squeeze bottle which can be unit close or multi dose. In another embodiment, the mono-hydrocarbyl quaternary ammonium component and anionic surfactant can be in any combination of physical forms. In one embodiment both components can be in powder form and contained in the same compartment or in different compartments of the same of separate containers. In another embodiment, one or more of the components is in liquid or gelled form.

Another embodiment of the present invention provides for a kit comprising a first package containing the mono-hydrocarbyl quaternary ammonium component, and a second package containing the anionic surfactant. The first and second packages can be separate or part of the same multi package unit, preferably labeled or marked such that a consumer understands the contents are to be used in combination. The physical form of the components can be liquid, gel, or powder. Those of skill in the art will understand that either the first or the second package can contain a certain amount of the other component, meaning that the packages do not have to be free of the component contained in the other package. Additional fabric enhancer compositions can be included in either the first and/or second package.

8. Methods of Use:

Another aspect of the invention provides for a method of forming a fabric enhancer composition comprising: combining the mono-hydrocarbyl quaternary ammonium compound with an anionic surfactant component, $A^-$, comprising a $C_6$ to $C_{10}$ hydrocarbyl chain, to form a di-hydrocarbyl complex. The di-hydrocarby complex can then be contacted with a fabric in the wash and/or rinse process. Those of skill in the art will understand that the step of combining the components can be performed by the manufacturer prior to the point of sale or can be performed by the consumer prior to use or in-situ in the washing and/or rinsing process. In one embodiment, the at least one of said cationic surfactant component and said anionic surfactant components is in powder form.

In one embodiment, the method further comprises a step of forming a coacervate in-situ said treated wash bath solution after the dispensing step of (a) or the contacting step of (b), wherein said anionic surfactant is provided from at least one of 1) said fabric enhancer composition when said fabric enhancer composition comprises said optional anionic surfactant, 2) from any anionic surfactant from said wash bath solution or said fabric, and 3) from any anionic surfactant provided by an optional rinse additive product.

EXAMPLES

The following are non-limiting examples of the fabric care compositions of the present invention.

| | EXAMPLE | | | | | | | | |
|---|---|---|---|---|---|---|---|---|---|
| (% wt) | I | II | III | IV | V | VI | VII | VIII | IX |
| DHC [a] | 12 | 5 | 4 | 2 | 16.1 | 5 | 5 | | |
| DHC [b] | | 7 | 4 | | | 5 | 5 | 1 | |
| DHC [c] | | | 4 | 10 | | 5 | 5 | | 1 |
| Deposition Aid [d] | 1.25 | 1.25 | 2.00 | 0.75 | 1.44 | 0.42 | 0.25 | 0.5 | 0.70 |
| Perfume | 1.50 | 1.50 | 1.50 | 1.50 | 1.50 | 0.60 | 0.60 | 1.30 | 0.8-1.5 |
| Suds Suppressor [f] | — | — | — | — | — | — | — | — | 0.1 |
| DTPA [g] | 0.005 | 0.005 | 0.005 | 0.005 | 0.007 | 0.002 | 0.002 | 0.20 | — |
| Preservative (ppm) [h] | 5 | 5 | 5 | 5 | 5 | 5 | 5 | — | 250 [i] |
| Antifoam [j] | 0.015 | 0.011 | 0.011 | 0.011 | 0.011 | 0.015 | 0.015 | — | — |
| Dye (ppm) | 40 | 40 | 40 | 40 | 40 | 30 | 30 | 11 | 30-300 |
| Deionized Water | Balance | Balance | Balance | Balance | Balance | Balance | Balance | Balance | Balance |

[a] Di-hydrocarbyl amido complex having a C12-C14 anionic component and a cationic component having $R_1$ of C16-C18.

[b] Di-hydrocarbyl amido complex having a C6-C8 anionic component and a cationic component having $R_1$ of C16-C18

[c] Di-hydrocarbyl amido complex having a C12-C14 anionic component and a cationic component having $R_1$ of C8-C12

[d] Cationic high amylose maize starch available from National Starch under the trade name HYLON VII ®., Hydrolyzed Cationic Maize Starch, Cationic Waxy Maize starch, US Patent Publ. 2007/0219111A1, paragraph 19.

[f] SE39 from Wacker

[g] Diethylenetriaminepentaacetic acid.

[h] KATHON ® CG available from Rohm and Haas Co. "PPM" is "parts per million."

[i] Gluteraldehyde

[j] Silicone antifoam agent available from Dow Corning Corp. under the trade name DC2310.

Solubility Examples

A series of samples having 20 ml of 10 mM stock solutions of cationic surfactant and 10 ml of 10 mM stock solution of anionic surfactant are prepared from the following surfactants:

Cationic Surfactants:

hexyl trimethyl ammonium bromide
octyl trimethyl ammonium bromide
decyl trimethyl ammonium bromide
dodecyl trimethyl ammonium bromide
tetradecyl trimethyl ammonium bromide
hexadecyl trimethyl ammonium bromide
octadecyl trimethyl ammonium bromide Anionic Surfactants:

sodium hexyl sulfate
sodium octyl sulfate
sodium decyl sulfate
sodium dodecyl sulfate
sodium tetradecyl sulfate
sodium hexadecyl sulfate
sodium octadecyl sulfate
sodium dodecyl benzene sulfonated Sample solutions are prepared by mixing the cationic surfactant and anionic surfactant in water. The solutions are then allowed to sit in room temperature for 48 hours. Samples are then viewed by naked eye for formation of any flocs or insoluble precipitates. Samples which form dihydrocarbyl amido vesicle complexes are within the scope of the invention. These samples tend to be turbid or cloudy and the vesicle structure can be confirmed by dynamic light scattering or electron microscopy.

It should be understood that every maximum numerical limitation given throughout this specification includes every lower numerical limitation, as if such lower numerical limitations were expressly written herein. Every minimum numerical limitation given throughout this specification includes every higher numerical limitation, as if such higher numerical limitations were expressly written herein. Every numerical range given throughout this specification includes every narrower numerical range that falls within such broader numerical range, as if such narrower numerical ranges were all expressly written herein.

All parts, ratios, and percentages herein, in the Specification, Examples, and Claims, are by weight and all numerical limits are used with the normal degree of accuracy afforded by the art, unless otherwise specified.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm".

Except as otherwise noted, the articles "a," "an," and "the" mean "one or more."

All documents cited in the Detailed Description of the Invention are, in relevant part, incorporated herein by reference; the citation of any document is not to be construed as an admission that it is prior art with respect to the present invention. To the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A fabric enhancer article comprising, a. a water-soluble film optionally comprising a polyvinyl alcohol;

b. from about 0.05 grams to about 100 grams of a fabric enhancer composition comprising: a quaternary ammonium compound comprising the structure:

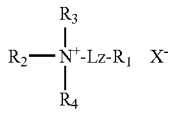

wherein $R_1$ comprises a $C_6$-$C_{18}$ hydrocarbyl chain, wherein R2, R3 and R4 are individually selected from the group consisting of C1-C4 hydrocarbyl, C1-C4 hydroxy hydrocarbyl, —$(CH_2CH_2O)_xH$ where x has a value from about 1 to about 2, and mixtures thereof, L is a linking group selected from the group consisting of C(O)O—, —$(CH_2CH_2O)_n$—, —C(O)—, [$CH_2CH(CH_2)O$] and n has value of 1 to 2 with z having a value of 0 or 1, and wherein $X^-$ is a anion, wherein said fabric enhancer composition is encapsulated by said water-soluble film said water-soluble film forming a multi-component pouch, wherein said multi-compartment pouch comprises a first compartment containing said fabric enhancer composition; and a second compartment containing an anionic surfactant.

2. The fabric enhancer article of claim 1, wherein said fabric enhancer composition further comprises from about 0% to about 15% of water.

3. The fabric enhancer article of claim 2, wherein said fabric enhancer composition further comprises from about 30% to about 70% of a solvent, said solvent comprising a polyethylene glycol, glycerin, propylene glycol, and mixtures thereof.

4. A method of softening a fabric through the wash and/or rinse process comprising:

dispensing into a wash and/or bath solution a fabric enhancer article according to claim 1

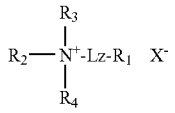

a. contacting a fabric with the treated wash and/or rinse bath solution of step (a).

* * * * *